United States Patent [19]

Famolare, Jr.

[11] 4,000,566

[45] Jan. 4, 1977

[54] SHOCK ABSORBING ATHLETIC SHOE WITH AIR COOLED INSOLE

[75] Inventor: Joseph P. Famolare, Jr., Florence, Italy

[73] Assignee: Famolare, Inc., New York, N.Y.

[22] Filed: Apr. 22, 1975

[21] Appl. No.: 570,438

[52] U.S. Cl. ..... 36/28; 36/3 B; 36/32 R

[51] Int. Cl.[2] ..... A43B 13/18; A43B 7/06; A43B 13/04

[58] Field of Search ..... 36/28, 32 R, 25 R, 59 R, 36/59 C, 67 D, 3 R, 3 A, 3 B

[56] References Cited

UNITED STATES PATENTS

| | | | |
|---|---|---|---|
| 1,985,578 | 12/1934 | Murray | 36/32 R |
| 3,327,334 | 6/1967 | Wilmanns et al. | 36/32 R |
| 3,494,055 | 2/1970 | McSorley | 36/59 R |

FOREIGN PATENTS OR APPLICATIONS

| | | | |
|---|---|---|---|
| 2,116,487 | 10/1972 | Germany | 36/32 R |
| 2,062,838 | 8/1972 | Germany | 36/3 B |

*Primary Examiner*—Patrick D. Lawson
*Attorney, Agent, or Firm*—Mandeville and Schweitzer

[57] ABSTRACT

Disclosed herein is a shoe construction, especially well suited for athletic footwear, comprising a one-piece molded sole having a bottom tread surface and an upper "fully orthopedic" foot supporting surface, a plurality of primary canals formed at the upper surface of the sole extending from the peripheral edges thereof inwardly in predetermined patterns, a foot supporting insole mounted upon the upper surface of the sole and cooperating with the primary canals to define ventilating air conduits, ventilating ports defined by the insole means and disposed in registry with the conduits, whereby ventilating air is free to communicate from exterior portions of the sole at peripheral portions thereof to the exposed internal surface of said insole, and a foot enclosing upper secured to said sole. Advantageously, the body of the sole between the canals is provided with cells or cavities which extend inwardly from the upper surface of the sole for the major portion of the thickness of said sole, whereby the cavities, in conjunction with the canals and the insole, provide the sole with an effective lightweight, strong, flexible and resilient honeycomb structure. Specifically, the lower portion of the sole is contoured to define a peripheral rim and a plurality of shock absorbing cylindrical members disposed inwardly thereof, the lower surfaces of the shock absorbing cylindrical members being disposed in a common plane with the peripheral rim, the cylindrical members being of sufficient depth so as to be compressible and laterally flexible in a manner whereby shock absorption is accommodated in three dimensions, along the X, Y and Z axes of the cylindrical members.

4 Claims, 5 Drawing Figures

SHOCK ABSORBING ATHLETIC SHOE WITH AIR COOLED INSOLE

BACKGROUND OF THE INVENTION

A plethora of shoe constructions having various cushioning, traction, shock absorption, and air cooling arrangements are known to the art. Representative of these arrangements are those shown in U.S. Pat. Nos. 2,725,645; 2,627,676; 1,606,529; 1,653,059; 1,711,302; 2,114,421; 3,043,025; 3,237,322; 3,316,662; 3,555,697; 3,803,731; and 3,849,915. The present invention represents a contribution to and an advance in the existing state of the art and provides a new and improved shoe construction, especially well suited for athletic shoes.

SUMMARY OF THE INVENTION

In accordance with the principles of the present invention, a new and improved unit sole having unique shock absorbing, traction, and cooling elements is molded from a resilient rubberlike material, such as "Kraton" thermoplastic rubber, a springy, styrene-butadiene block copolymer, produced by Shell Chemical Company. The new unit sole has a foot conforming or so-called "orthopedic" upper surface, which is provided with a network of air canals which directly communicate with the ambient atmosphere outside of the sole to permit air to flow into the sole structure and pass through the insole to cool the bottom of the feet of the wearer of the new athletic shoe. The insole, as will be understood, may be provided with a series of perforations or air ports in registry with the canals to allow air flowing through the canals to circulate within the shoe.

Air circulation is enhanced by the natural pumping action occasioned by the compression and expansion of the resilient sole unit itself during the use thereof.

As a further important aspect of the present invention, a new and improved tread configuration is provided at the lower surface of the sole to provide enhanced traction, shock absorption and proplusion characteristics to athletic soles of this general type. Specifically, the lower surface of the shoe is provided with a peripheral rim which lies in the lower plane of the sole. The remainder of the traction surface, representing a minor portion of the entire foot profile, is comprised of cylindrical shock absorbers, the lower surfaces of which lie in the plane of the peripheral rim. The top portion of the sole is upwardly canted and elevated with respect to the remainder of the sole, while the rearwardmost portion is slightly beveled.

Each of the cylindrical shock absorbers are of sufficient depth so as to be compressible and laterally flexible in a manner whereby to provide substantial shock absorption. In addition, the configuration and array of the shock absorbers is such as to provide extraordinary and universal traction on a wide variety of athletic surfaces ranging from natural and synthetic turf and comparable soft surfaces to hard surfaces, both synthetic and natural. Moreover, the construction and recessing of the traction elements with respect to the lowermost plane of the sole tends to protect sensitive surfaces from undue damage.

For a more complete understanding of the present invention and a better appreciation of its attendant advantages, reference should be made to the following detailed description of an illustrative embodiment thereof taken in conjunction with the accompanying drawings.

DESCRIPTION OF A PREFERRED EMBODIMENT

Figure 1:
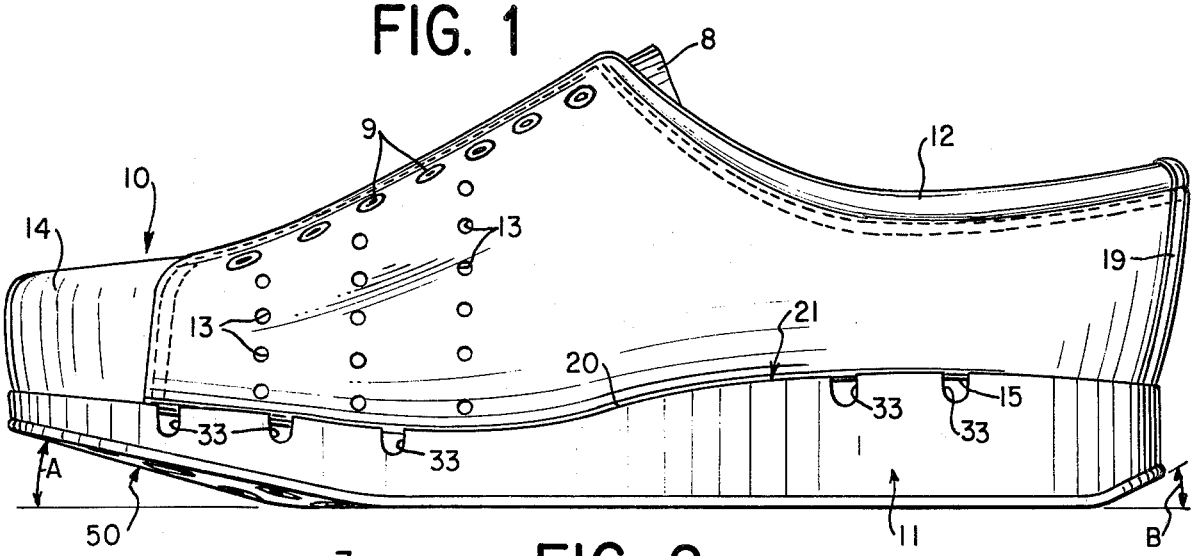
FIG. 1 is a side elevational view of a new and improved athletic shoe embodying the principles of the invention.

Referring now to FIG. 1, the athletic shoe of the present invention comprises an upper 10 of any generally well known configuration which may be made of leather, textile, synthetic, or like upper material or any combination thereof, which is adhered to a new and improved natural or synthetic rubber, for example, "Kraton," unit sole bottom 11, by suitable adhesives and/or vulcanization or other conventional techniques for bonding uppers to lowers. (See, for example, U.S. Pat. Nos. 3,477,148 and 3,501,855, the disclosures of which are incorporated by reference herein). Advantageously, the upper may be of the "oxford" type and includes a tongue 8, eyelets 9, a reinforced heel support 19, a cushioned collar 12, suitable ventilating ports 13 and a box toe 14, all of which details are, of course, well known to the art and form no part of the present invention.

As is conventional with athletic shoes of this type, the upper has a cicumscribing flange or lower edge portion 15 (FIG. 2) which is adhered by adhesive 16 to the top surface 17 of the unit sole bottom 11. An insole 18 of leather, textile or appropriate sheet material is superimposed over the flange 15 and is adhered thereto and to the top surface 17 of the bottom member 11 by the adhesive 16 to form a foot supporting surface.

Figure 2:
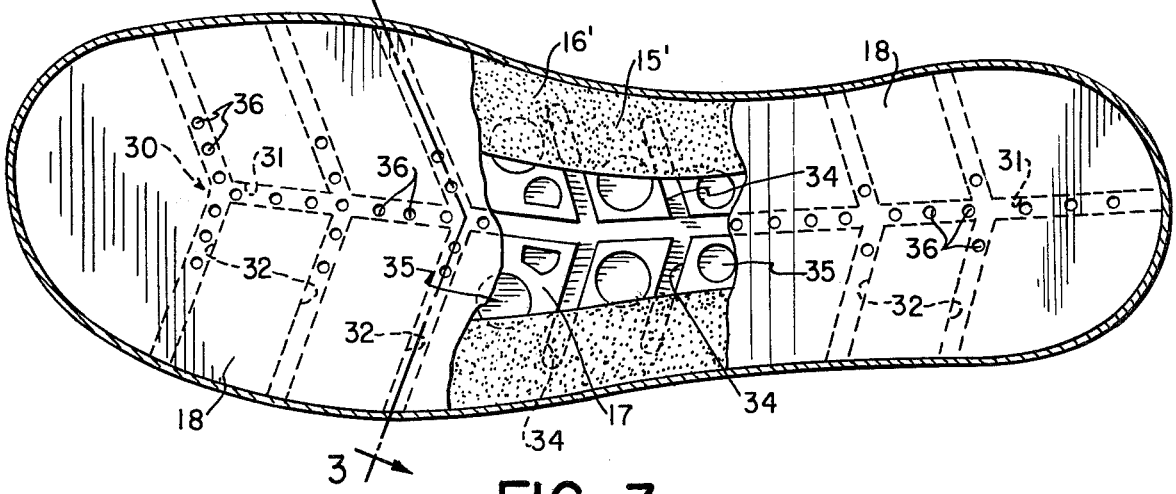
FIG. 2 is a plan view of the insole of the present invention with parts broken away to show details of construction of the new athletic shoe.
Figure 3:
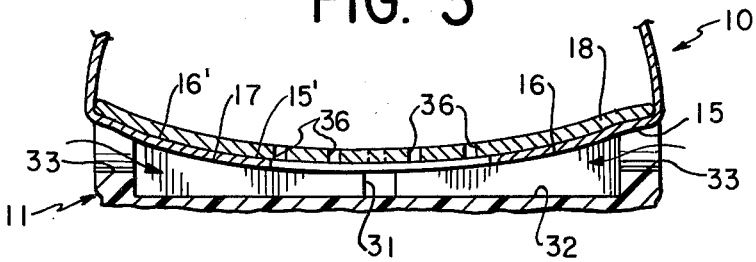
FIG. 3 is a fragmentary, cross-sectional view taken along line 3—3 of FIG. 2.

The new unit sole 11 has a circumscribing upper rim 20 into which is nested the flange or lower edge portions 15 of the upper 10, as shown in FIG. 2. The contour of the upper surface 17 of the unit sole 11 is foot conforming or so-called "orthopedic." That is to say, the arch portion 21 (FIG. 1) is elevated and specifically contoured to support the arch at the instep of the wearer's foot, and the remainder of the sole is similarly contoured to conform to the anatomy of a foot bottom. Thus, as shown in FIG. 3, ball supporting portions of the upper surface 17 of the sole are generally concave, as are the heel supporting portions of the sole 11. More specifically, and in accordance with the principles of the invention, a network of air canals 30 is formed at the upper surfaces 17 of the unit sole 11. The network 30 includes a canal 31 extending from the rear edge of the sole to the ball portion thereof, and a series of chevron-shaped canals 32 intersecting the major canal 31 and extending completely across the upper surface of the soles. Each of the canals 31, 32 terminates in an air port 33 at the side edge of the sole. In accordance with the invention, cooling air is pumped through the port into and out of the network 30 by the expansion and contraction of the sole during walking. More specifically, the network additionally includes chevron-shaped tributary canals 34 in the center of the sole, which canals 34 terminate inwardly of the rim 20 circumscribing the sole. As shown in FIG. 3, air is free to enter ports 33 and travel through the canals 31, 32 through the sole body and up through perforations 34, formed in the insole 18 to cool the bottom surfaces of the foot of a wearer, as will be appreciated.

In order to enhance the resilience of the unit sole 11, as well as to generally reduce its overall weight and to provide it with a general internal honeycomb structure, a series of cells or voids 35 are formed in the regions between the canals 31, 32 forming the network 30. In the embodiment of the sole shown in FIG. 2, the voids are generally circular in cross section, generating an irregular, cellular honeycomb structure in the sole, however, it is to be understood that the walls of the honeycomb may be uniform and the individual cells in the honeycomb may be any shape desired or found necessary. It will be appreciated, of course, that the honeycomb structure enhances, by mechanical means, the inherent resilience of the particular rubber composition used in the molding of the unit sole 11.

The running, walking and/or other treading characteristics of the new athletic shoe are further enhanced, along with the shock absorbing characteristics of the new shoe, by the configuration of the lower surfaces of the unit sole 11, as well as its overall contour. Specifically, the forward portions from the ball of the foot to the toe are elevated with respect to the major remaining portions of the sole at an angle of elevation A of approximately 15°–20°. Similarly, the rearwardmost portion is elevated with respect to the horizontal major portions of the sole by an angle B of approximately 15°–20°.

Figure 4:
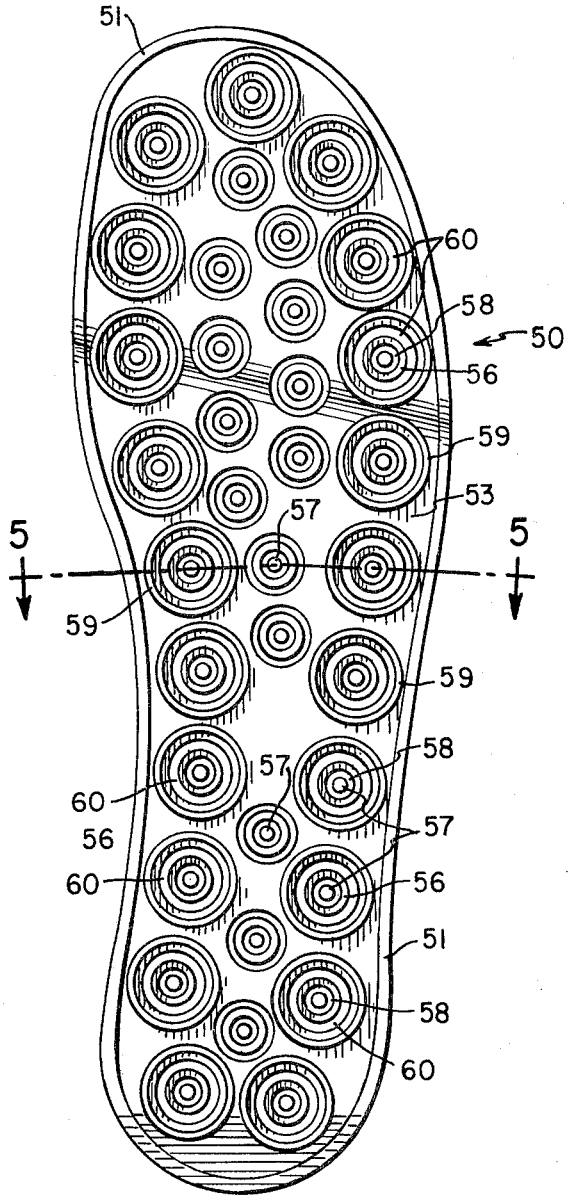
FIG. 4 is a bottom plan view of the unit sole of the new athletic shoe.
Figure 5:
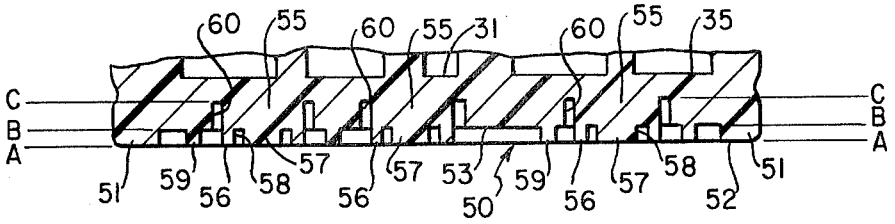
FIG. 5 is an enlarged fragmentary, cross-sectional view of the sole taken along line 5—5 of FIG. 4 to show details of construction thereof.

Referring now to FIGS. 4 and 5, the tread 50 at the bottom of the new unit sole is especially formed and arranged to maximize traction and shock absorption.

Circumscribing the sole 11 is a rim or bead 51, the flat lowermost surfaces 52 of which are definitive of a primary bottom plane A—A of the sole. Recessed and tertiary bottom surfaces 53, 54 in secondary bottom planes b—B and C—C, respectively, are disposed parallel to the primary plane A.

Extending downwardly from plane C—C are major or primary cylindrical shock absorbing elements 55, each having a bottom surface 56 disposed in plane A—A and being separated from the remainder of the sole by an annular recess 60. These elements 55 are arrayed about the periphery of the sole bottom as well as throughout the central area of the sole bottom 11, as shown in FIG. 4. Enhanced shock absorption and traction are obtained by providing each of the major shock absorbers 55 with a mini-shock absorber 57 of cylindrical shape and formed in the lowermost portions of the absorber elements 55 by annular recesses 58 concentric therewith. Advantageously, still further enhancement of the traction and shock absorption of the sole is provided by surrounding each of the shock absorbers 55 adjacent the rim 51 with a shallow ring tread 59 extending from plane B—B to plane A—A, as shown in FIG. 5.

In accordance with the invention, the aforementioned array of tread elements 50–60 are free, owing to their size and configuration, to be displaced by flexion and compression in the X, Y and Z axes upon impact of the sole. Thus, they provide extraordinary shock absorption and traction on a wide variety of surfaces (hard, soft, smooth, rough, turflike, cinder, etc.). Moreover, individual areas of the sole may bend, along the canals, relative to and independently of one another in use, by virtue of their shape and location and the slope of the forwardmost and rearwardmost sole portions.

It should be understood that the new sole, fabricated from an elastomeric material, such as natural or synthetic rubber (advantageously, "Kraton" thermoplastic rubber, a styrene-butadiene block polymer described in more detail at pp. 114 and 116 of the 1973–1974 Modern Plastics Encyclopedia, the disclosure of which is incorporated by reference herein), is extraordinarily resilient and comfortable due to the inherent characteristics of the rubber material from which it is formed in combination with the physical characteristics imparted thereto by the honeycomb internal structure and special external tread structure and, therefore, the new sole is especially well suited for shoes of all types to be used by people during athletic endeavors, walking, standing, or working. Accordingly, while the construction of the shoe of the present invention is such that it is eminently well suited for athletic shoe use, its extreme comfort, traction, and shock absorption characteristics, and air cooling make it an ideal construction for use in other types of shoes, boots, and footwear.

It should be understood that the shoe construction described herein is intended to be representative only, as certain changes may be made therein without departing from the clear teachings of the disclosure. Accordingly, reference should be made to the following appended claims in determining the full scope of the invention.

I claim:

1. A homogeneous unit sole construction comprising a. a one-piece molded sole of resilient elastomeric material having a bottom tread surface and an upper foot supporting surface;

b. the lowermost portion of said sole is specifically contoured to define a continuous peripheral rim and a plurality of primary shock absorbing cylindrical means disposed inwardly thereof and spaced thereform and from one another by first recessed annular portions;

c. the bottom surfaces of said shock absorbing cylindrical means being disposed in a common plane with the bottom surfaces of said peripheral rim means;

d. each of said cylindrical shock absorbing means containing a secondary mini-cylindrical shock absorbing means concentric therewith;

e. said mini-shock absorbing means being defined by second annular recess portions defined in the lowermost portions of said aforementioned primary cylindrical shock absorbing means, said first annular recess portions being deeper than said second annular recess portions with respect to the bottommost surfaces of said unit sole;

f. annular tread means disposed concentrically with a predetermined number of said aforementioned primary shock absorbing means and said secondary mini-shock absorbing means; the bottom surfaces of said primary shock absorbing means, said secondary shock absorbing means, and said tread means being disposed in a common plane with said bottom surfaces of said peripheral rim means;

g. said primary and secondary shock absorbing means being of sufficient depth so as to be compressible and laterally flexible in a manner whereby shock absorption is accommodated in three dimensions, along the X, Y and Z-axes of each of said shock absorbing means;

h. said sole being of non-uniform thickness along its length from heel portion to shank portion to toe portion, said heel portion having a thickness substantially greater than said toe portion and said shank portion being thicker than said heel portion; and i. said toe portion being substantially elevated with respect to said shank portion.

2. The sole of claim 1, further characterized in that a. the bottom surfaces of the forwardmost sole portions are disposed at an angle of approximately 20° with the horizontal surfaces of the remainder of said sole;

b. said lower surfaces of the beveled heel portion are disposed at an angle of approximately 20° with the horizontal base portion of the remainder of said sole.

3. The sole of claim 1, in which a. said tread means being disposed in a pattern congruent with the plan elevational shape of said sole and being disposed promimately of the inner edges of said rim means.

4. The sole of claim 1, in which a. a plurality of canal means are formed at the upper surface of said sole extending from the peripheral edges thereof inwardly in predetermined patterns.

* * * * *